US006572224B2

(12) United States Patent
Wakayama et al.

(10) Patent No.: US 6,572,224 B2
(45) Date of Patent: Jun. 3, 2003

(54) INK CONTAINER

(75) Inventors: Takahiro Wakayama, Ibaraki-ken (JP); Toru Hibara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/949,620

(22) Filed: Sep. 12, 2001

(65) Prior Publication Data

US 2002/0054193 A1 May 9, 2002

(30) Foreign Application Priority Data

Sep. 12, 2000 (JP) ..... 2000-227237
Sep. 12, 2000 (JP) ..... 2000-277238

(51) Int. Cl.[7] ..... B41J 2/175
(52) U.S. Cl. ..... 347/86
(58) Field of Search ..... 347/85, 86, 87, 347/7; 141/23, 25

(56) References Cited

U.S. PATENT DOCUMENTS 5,500,665 A * 3/1996 Ujita et al. ..... 347/86
5,504,511 A * 4/1996 Nakajima et al. ..... 347/86
5,889,543 A * 3/1999 Miyazawa et al. ..... 347/86

FOREIGN PATENT DOCUMENTS

| | | |
|---|---|---|
| EP | 0529626 A | 3/1993 |
| EP | 1157843 A | 11/2001 |
| JP | 60 204355 | 10/1985 |

* cited by examiner

*Primary Examiner*—Michael Nghiem
(74) *Attorney, Agent, or Firm*—Nixon Peabody LLP; Donald R. Studebaker

(57) ABSTRACT

An ink container has a cylinder provided with an ink discharge port at its leading end and a piston fitted in the cylinder to be slidable along the inner surface of the side wall of the cylinder. Ink is filled into the space defined by the cylinder and the piston. Resistance generated by friction between the cylinder and the piston when the piston is slid toward the ink discharge port with the ink container held empty is not lower than 1.0N.

18 Claims, 7 Drawing Sheets

INK CONTAINER

BACKGROUND OF THE INVENTION

1. Field of the Invention

This invention relates to a printing ink container comprising a cylinder provided with an ink discharge port at its leading end and a piston received in the cylinder to be slidable along the inner surface of the cylinder, ink being filled into the space defined by the cylinder and the piston.

2. Description of the Related Art

There has been known a printing ink container comprising a cylinder provided with an ink discharge port at its leading end and a piston received in the cylinder to be slidable along the inner surface of the cylinder. Ink is filled into the space defined by the cylinder and the piston. An elastic ink scraper portion is mounted along the rim of the piston. As the ink in the container is consumed, the piston slides toward the ink discharge port under the atmospheric pressure. When the piston slides toward the ink discharge port, the ink scraper portion scrapes ink off the inner surface of the cylinder.

In a printer, such an ink container is generally mounted to be removable from the printer body, and when the ink in the ink container is consumed, the ink container is replaced with a new refill (a disposable type) or the ink container is removed from the printer body, refilled with ink and then returned to the printer body (a reusable type).

In the case of a disposable type ink container, empty containers may be recycled to make material for other plastic products.

Which ever type is employed, it is necessary to watch the remainder of ink in the ink container, or the ink can suddenly run out to force the printer to be stopped until the ink container is replaced with a new refill or the ink container is refilled with ink. That the time efficiency is high is a strong point of a stencil printer. However when the ink suddenly runs out to force the printer to be stopped until the ink container is replaced with a new refill or the ink container is refilled with ink, such a strong point of the printer is hurt. Accordingly, it is necessary that the ink is about to be exhausted is recognized at least immediately before the ink actually runs out.

This problem can be overcome in the simplest way by the user visually watching the remainder of ink. However since the ink container is generally placed deep in the printer, the user must check the remainder of ink by taking out the ink container and opening the cap with the printer stopped. If the ink container is of transparent or semitransparent material, the user can check the remainder of ink with the cap kept on. However these actions are troublesome to the user. Accordingly, systems for detecting that the remainder of ink in the ink container becomes small have been proposed or have been put into practice.

For example, there has been proposed a system in which a light emitter is positioned on one side of a semitransparent ink container with a plurality of light receivers positioned on the opposite side of the ink container so that when ink exists between a combination of the light emitter and the light receiver, light emitted from the light emitter cannot be received by the light receiver. The remainder of ink in the ink container can be detected on the basis of which light receiver receives light. In this system, the remainder of ink can be detected in a plurality of stages, e.g., the ink container is full, the remainder of ink is not smaller than a predetermined amount, or the remainder of ink is smaller than the predetermined amount.

The ink container is generally provided with an elastic ink scraper portion mounted along the rim of the piston to better scrape the ink off the inner surface of the cylinder. However, when a gap is produced between the piston and the inner surface of the cylinder due to, for instance, deformation of the cylinder, a part of the ink adhering to the inner surface of the cylinder cannot be scraped off the inner surface of the cylinder and is kept on the inner surface of the cylinder. When such unsatisfactory ink scraping occurs, the residual ink on the inner surface of the cylinder deteriorates the light transmission of the cylinder, which adversely affects detection of the remainder of ink in the ink container.

Further when some ink is left on the inner surface of an empty container, the ink left on the inner surface of the empty container, which can have undergone change with time, mixes with ink newly filled into the container.

When the ink containers are recycled to reuse them to another plastic product, the ink left on the inner surface of the empty container mixes in the product.

Further, the unsatisfactory ink scraping increases the amount of wasted ink.

SUMMARY OF THE INVENTION

In view of the foregoing observations and description, the primary object of the present invention is to provide a printing ink container which can suppress generation of unsatisfactory ink scraping.

Another object of the present invention is to provide a printing ink container which can ensure a high light transmission of the cylinder, thereby facilitating detection of the remainder of ink in the ink container.

In accordance with the present invention, there is provided an ink container comprising a cylinder provided with an ink discharge port at its leading end and a piston fitted in the cylinder to be slidable along the inner surface of the side wall of the cylinder so that ink is filled into the space defined by the cylinder and the piston, wherein the improvement comprises that resistance generated by friction between the cylinder and the piston when the piston is slid toward the ink discharge port with the ink container held empty is not lower than 1.0N.

It is preferred that the resistance be not lower than 2.5N.

Further, it is preferred that at least one annular ink scraper portion be provided on the piston to extend radially outward so that its surface facing toward the ink discharge port makes an angle not smaller than 90° to the inner surface of the side wall of the cylinder as measured toward the ink discharge port from the surface facing toward the ink discharge port.

It is preferred that a plurality of the pistons are fitted in the cylinder.

The ink container of the present invention may be incorporated in a printing device comprising a photodetector which outputs an electric signal according to the amount of light the photodetector receives, a light projecting means which projects detecting light toward the photodetector through the side wall of the cylinder, and an ink remainder detecting means which detects the remainder of ink in the ink container on the basis of the electric signal output from the photodetector.

In this case, it is preferred that the photodetector be disposed near the trailing end of the cylinder, a plurality of the light projecting means are provided in a plurality of different positions in the longitudinal direction of the cylinder and are turned on in different manners by position, and the ink remainder detecting means detects the remainder of ink in the ink container on the basis of change in the electric signal output from the photodetector.

When the ink container of the present invention is incorporated in such a printing device, it is preferred that the resistance generated by friction between the cylinder and the piston when the piston is slid toward the ink discharge port with the ink container held empty is at least 2.5N at the portion where the light projecting means projects the detecting light.

When the resistance generated by friction between the cylinder and the piston when the piston is slid toward the ink discharge port with the ink container held empty is not lower than 1.0N, the piston can satisfactorily scrape ink off the inner surface of the side wall of the cylinder, whereby the events that the residual ink on the inner surface of the cylinder deteriorates the light transmission of the cylinder and adversely affects detection of the remainder of ink in the ink container, or the ink left on the inner surface of the empty container mixes in the product when the ink containers are recycled to reuse them to another plastic product can be avoided. Further, ink in the ink container can be fully used without running to waste.

When at least one annular ink scraper portion is provided on the piston to extend radially outward so that its surface facing toward the ink discharge port makes an angle not smaller than 90° to the inner surface of the side wall of the cylinder as measured toward the ink discharge port from the surface facing toward the ink discharge port, ink is better scraped off the inner surface of the side wall of the cylinder, whereby generation of unsatisfactory ink scraping can be more surely avoided.

Further, when a plurality of the pistons are fitted in the cylinder, ink is further better scraped off the inner surface of the side wall of the cylinder, whereby generation of unsatisfactory ink scraping can be further more surely avoided.

We have found that the ink remainder can be accurately detected even if unsatisfactory ink scraping is generated by forming the cylinder so that the gross transmittance y [% t] to light at 900 nm of the side wall of the cylinder after ink is scraped off the inner surface of the sidewall of the cylinder satisfies formula y=ax, wherein a is a coefficient not smaller than 21 and x represents a minimum output voltage of the photodetector.

In this specification, the "gross" transmittance to light at 900 nm of the side wall of the cylinder is defined to be the overall transmittance to light at 900 nm of the side wall of the cylinder and the ink left on the inner surface of the side wall, if any, and the "net" transmittance to light at 900 nm of the side wall of the cylinder is defined to be the transmittance to light at 900 nm of the side wall of the cylinder free from any stain.

The coefficient a is empirically obtained on the basis of the relation between the output voltage of the photodetector and the gross transmittance of the side wall of the cylinder. For example, light is received by a photodetector through side walls of the cylinder having different transmittances and the output voltages of the photodetector are detected and plotted against transmittances of the side wall of the cylinder. Then the inclination of a straight line representing the plot is taken as the coefficient a.

Though the minimum output voltage of the photodetector varies by the performance of the photodetector, the term "minimum output voltage of the photodetector" should be interpreted to be the minimum voltage that a detecting means for detecting the output voltage of the photodetector can detect.

It is preferred that the coefficient a be not smaller than 36.

DESCRIPTION OF THE PREFERRED EMBODIMENT

Figure 1:
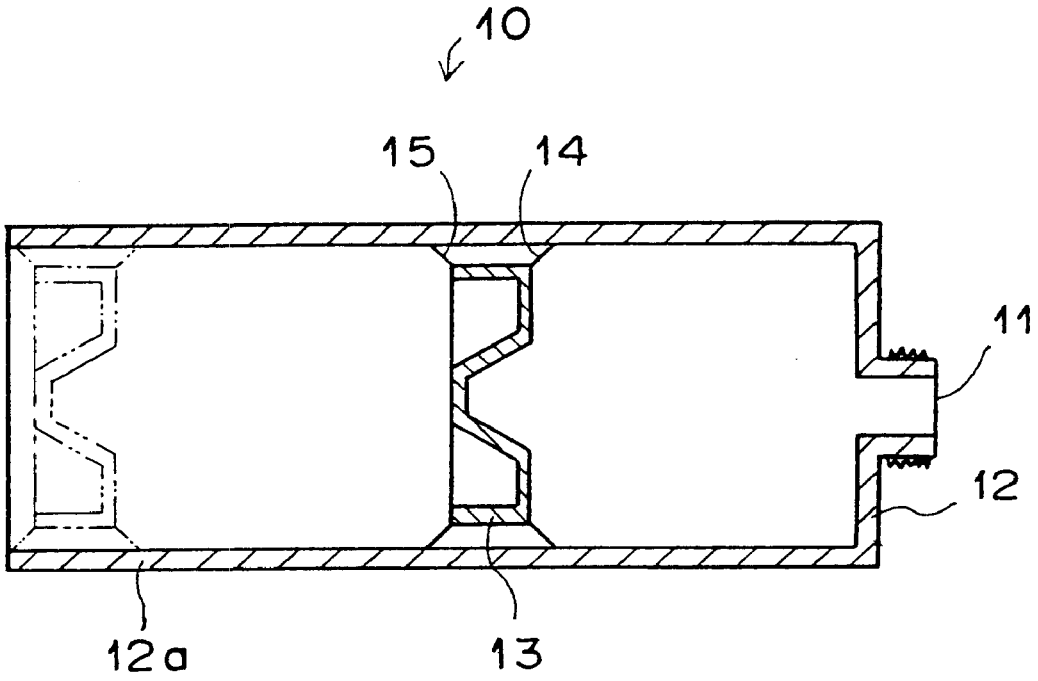
FIG. 1 is a cross-sectional view of an ink container in accordance with an embodiment of the present invention.

In FIG. 1, an ink container 10 in accordance with an embodiment of the present invention comprises a cylinder 12 which is substantially cylindrical in shape and has an ink discharge port 11 in the front end face thereof, and a piston 13 which is fitted in the cylinder 12 to be slidable along the inner side surface 12*a* of the cylinder 12 toward the ink discharge port 11. Ink is contained in the space in the cylinder 12 between the front end face and the piston 13. The piston 13 is provided with an annular ink scraper portion 14 and an annular piston support portion 15 which extend radially outward from the rim of the piston 13 at the leading end and the trailing end thereof. The ink scraper portion 14 is in a close contact with the inner surface of the side wall of the cylinder 12 to form a tightly closed space between the cylinder 12 and the piston 13.

Figure 2A:
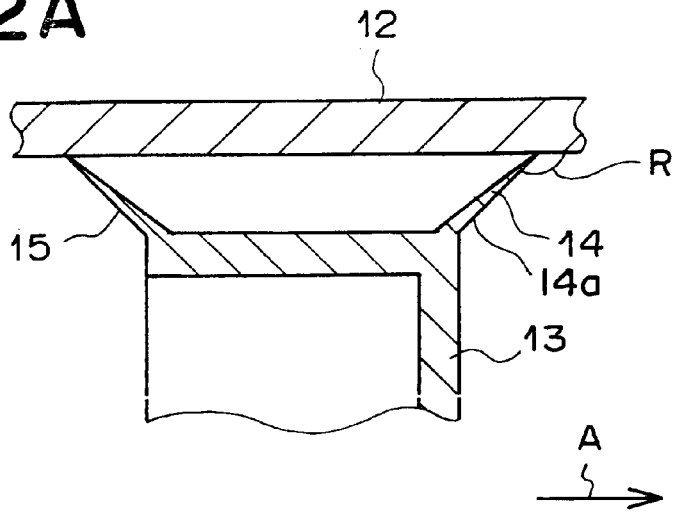
FIG. 2A is an enlarged fragmentary view showing a part of the piston.

As shown in FIG. 2A, the surface 14*a* of the ink scraper portion 14 in contact with the ink (i.e., facing toward the ink discharge port 11) makes an angle R not smaller than 90° to the inner surface of the side wall of the cylinder 12 as measured toward the ink discharge port 11 from the surface 14*a* toward the ink discharge port 11. In FIG. 2A, arrow A indicates the direction in which the piston 13 is moved (toward the ink discharge port 11).

The piston 13 is moved toward the ink discharge port 11 under the atmospheric pressure as the ink is discharged through the ink discharge port 11 and the remainder of the ink in the ink container 10 becomes smaller while the ink scraper portion 14 scrapes ink off the inner surface of the side wall of the cylinder 12.

Figure 2B:
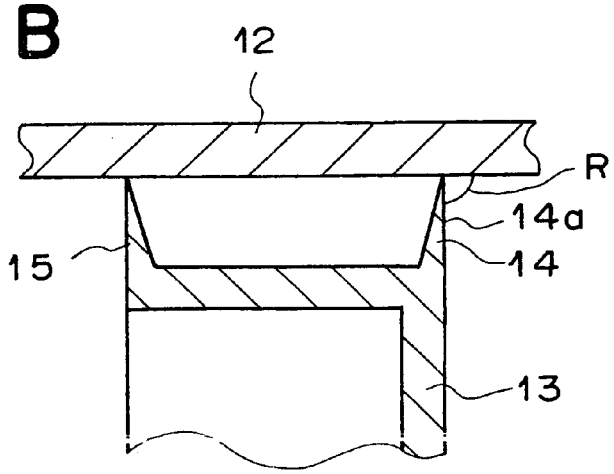
FIGS. 2B and 2C are views similar to FIG. 2A showing modifications of the piston.
Figure 2C:
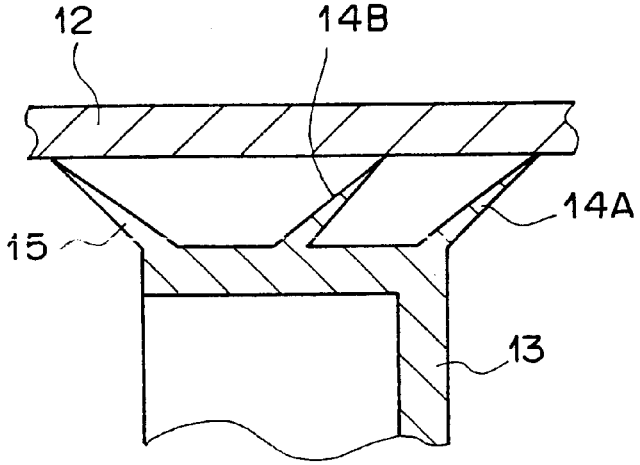

The angle R between the surface 14*a* of the ink scraper portion 14 and inner surface of the cylinder 12 may be any angle not smaller than 90° and may be just 90° as shown in FIG. 2B. Further, if desired, a pair of ink scraper portions 14A and 14B may be provided on the piston 13 as shown in FIG. 2C.

The cylinder 12 and the piston 13 may be formed of any material though it should be selected taking into account chemical resistance to the components of the ink, change in size of the cylinder 12 and the piston 13 due to swelling by the components of the ink, preservation of the ink, sliding friction between the cylinder 12 and the piston 13, flexibility of the ink scraper portion 14, and the like. Generally, the cylinder 12 and the piston 13 may be formed by injection molding of plastic material such as polypropylene (pp), high-density polyethylene (HDPE), polyvinyl chloride (PVC), polyethylene terephthalate (PET), polycarbonate (PC), polyoxymethylene (POM), polysulfone (PSF), polyether sulfone (PES), polyacrylate (PAR), polyamide (PA) and the like. Among those, polypropylene (pp) and high-density polyethylene (HDPE) are especially preferred since they are general purpose plastic excellent in resistance to solvents and inexpensive. Especially, it is preferred that the ink scraper portion 14 and the piston support portion 15 be formed of polypropylene (pp) or high-density polyethylene (HDPE) since they are preferably formed of flexible material. It is preferred that the ink scraper portion 14 and the piston support portion 15 be formed larger in the outer diameter than the inner diameter of the cylinder 12 so that they are pressed against the inner surface of the cylinder 12 under their own resiliency. The cylinder 12 and the piston 13 need not be formed of plastic but may be formed of other materials such as paper permeable to light.

In accordance with the present invention, the cylinder 12 and the piston 13 are sized so that resistance generated by friction between the cylinder 12 and the piston 13 when the piston 13 is slid toward the ink discharge port 11 with the ink container 10 held empty is not lower than 1.0N (more preferably not lower than 2.5N. With this arrangement, generation of unsatisfactory ink scraping can be avoided. For example, when the cylinder 12 is formed of polypropylene and the piston 13 is of high-density polyethylene, the resistance can be not smaller than 1.0N by setting the inner diameter of the cylinder 12 to 76.3±0.05 mm (76.3 mm in average) and setting the outer diameter of the piston 13 (including the ink scraper portion 14 and the piston support portion 15) as measured before the piston 13 is inserted into the cylinder 12 to at least 76.6 mm. Further, when the cylinder 12 is formed of polypropylene and the piston 13 is of high-density polyethylene, the resistance can be not smaller than 2.5N by setting the inner diameter of the cylinder 12 to 76.3 mm and setting the outer diameter of the piston 13 as measured before the piston 13 is inserted into the cylinder 12 to at least 76.9 mm.

In the ink container 10 of this embodiment, ink adhering to the inner surface of the side wall of the cylinder 12 can be well scraped off by the piston 13, whereby the events that the residual ink on the inner surface of the cylinder 12 deteriorates the light transmission of the cylinder 12 and adversely affects detection of the remainder of ink in the ink container 10, or the ink left on the inner surface of the empty container 10 mixes in the product when the ink containers are recycled to reuse them to another plastic product can be avoided. Further, ink in the ink container 10 can be fully used without running to waste.

Figure 3:
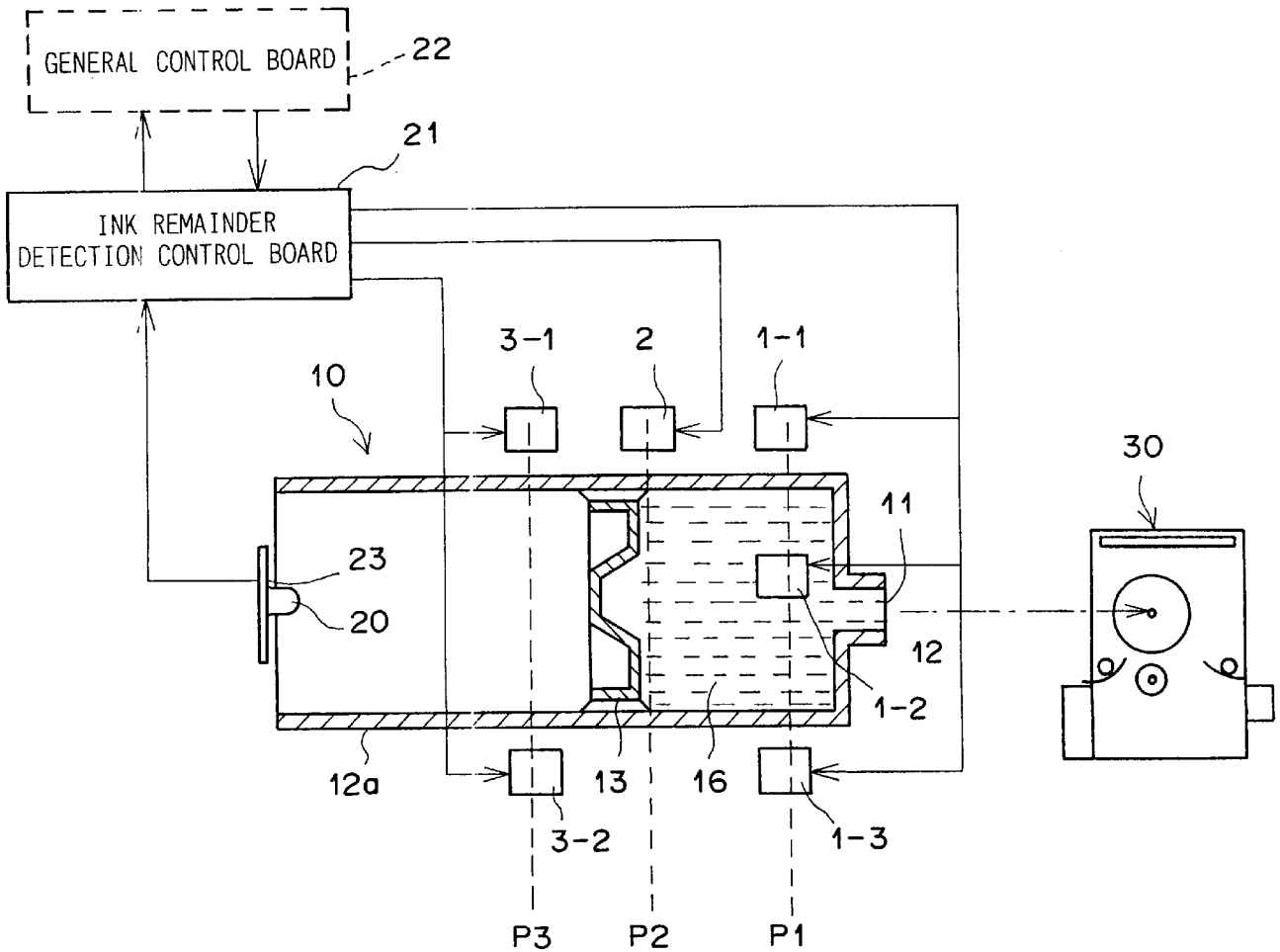
FIG. 3 is a schematic view showing a printer employing the ink container in accordance with the embodiment of the present invention.

FIG. 3 shows a stencil printer employing the ink container 10. The stencil printer comprises a printing mechanism 30 which prints on printing media (not shown) such as printing paper, transparent sheets for an OHP and the like and of a known structure including a printing drum, a sheet conveyance mechanism and the like; the ink container 10; an ink remainder detection control board 21 which concerns with detection of the remainder of the ink; and a general control board 22 for controlling the overall stencil printer.

Since the printing mechanism 30 is of a known structure, the printing mechanism 30 will not be described here.

The ink container 10 is filled with ink 16.

A photodetector 20 is held by a board 23 in the rear end portion of the cylinder 12. The photodetector 20 is preferably a photoelectric convertor such as a phototransistor or a photodiode which outputs an electric signal upon receipt of light. In this particular embodiment, the photodetector 20 is a phototransistor.

In three positions P1, P2 and P3 arranged in the longitudinal direction thereof (the direction in which the piston 13 is slid) along the cylinder 12, first to third LEDs 1 to 3 are disposed. The position P1 is a position where the piston 13 is positioned when the remainder of the ink 16 in the ink container 12 is 10%, and in this particular embodiment, three first LEDs 1 (1-1, 1-2, 1-3) are disposed in the position P1 at regular intervals (at 120°) in the circumferential direction of the cylinder 12. The position P2 is a position where the piston 13 is positioned when the remainder of the ink 16 in the ink container 12 is 30%, and in this particular embodiment, only one second LED 2 is disposed in the position P2. The position P3 is a position where the piston 13 is positioned when the remainder of the ink 16 in the ink container 12 is 50%, and in this particular embodiment, a pair of third LEDs 3 (3-1, 3-2) are disposed in the position P3 at regular intervals (at 180°) in the circumferential direction of the cylinder 12.

Light emitted from each of the LEDs 1, 2 and 3 is received by the photodetector 20 after once passing through the side wall of the cylinder 12 so long as no ink exists in the part of the ink container 12 opposed to the LED. Whereas when there remains ink 16 in the part of the ink container 12 opposed to the LED, light emitted from the LED is cut by the ink 16 and cannot impinge upon the photodetector 20. At this time, output of the photodetector 20 is 0 or very small.

In the ink container 10, the ink 16 can be sometimes left on the inner side surface 12*a* of the cylinder 12 in a stripe pattern, which can cut the light emitted from the LED even there remains no ink 16 in part of the ink container 12 opposed to the LED. However, in the positions P1 and P3, since there are disposed a plurality of LEDS, the light emitted from all the LEDs will not be cut by the stain of ink.

The LEDs are turned on and off under the control of the ink remainder detection control board 21. The three first LEDs 1 (1-1, 1-2 and 1-3) in the position P1 are turned on simultaneously and the pair of third LEDs 3 (3-1 and 3-2) in the position P3 are turned on simultaneously. In this printer, the remainder of the ink is detected in the following manner. All the first LEDs 1 (1-1, 1-2, 1-3) are first turned on, and the output signal of the photodetector 20 is detected. That is, whether the remainder of the ink in the container 10 is not larger than 10% is detected.

Then the first LEDs 1 (1-1, 1-2, 1-3) are turned off and the second LED 2 is turned on, and the output signal of the photodetector 20 is detected. That is, whether the remainder of the ink in the container 10 is not larger than 30% is detected.

Then the second LED 2 is turned off and the third LEDs 3-1 and 3-2 are turned on, and the output signal of the photodetector 20 is detected. That is, whether the remainder of the ink in the container 10 is not larger than 50% is detected.

Subsequently, the remainder of the ink 16 in the ink container 10 is logically determined on the basis of the results of the three detections of the output signal of the photodetector 20. That is, when the output signal of the photodetector 20 is detected in all the three detections, i.e., when the photodetector 20 receives light from all the first to third LEDs, it is determined that the remainder of the ink 16 is not larger than 10%.

When the output signal of the photodetector 20 is detected in only the second and third detections, i.e., when the photodetector 20 receives light from only the second and third LEDs, it is determined that the remainder of the ink 16 is not smaller 10% and not larger than 30%.

When the output signal of the photodetector 20 is detected in only the third detection, i.e., when the photodetector 20 receives light from only the third LEDs, it is determined that that the remainder of the ink 16 is not smaller 30% and not larger than 50%.

When the output signal of the photodetector 20 is detected in none of the first to third detections, i.e., when the phototransistor 20 receives light from none of the first to third LEDs, it is determined that the remainder of the ink 16 is larger than 50%.

The remainder of the ink 16 thus determined is temporarily stored in a memory (not shown).

When the ink remainder can be detected in this manner, it can be judged on the basis of the remainder of ink whether the ink container 12 is to be replaced by a new refill or whether the ink container 12 is to be replenished with ink. For example, when it has been known that a number of copies are to be printed in the next printing, it can be judged that one or more refills should be prepared even though more than 50% of ink remains in the ink container 12.

In accordance with the ink container 10 of this embodiment, generation of unsatisfactory ink scraping is prevented, and accordingly, light projected from the LEDs can be surely received by the photodetector 20 without blocked by ink left on the inner surface of the cylinder 12, whereby the ink remainder can be accurately detected.

In this embodiment, the color of ink, the wavelength of the emitted from the light projecting means, and the like need not be limited to a particular range. Further, it is possible to improve accuracy in detecting the ink remainder by increasing light collecting efficiency, for instance, by disposing a light condenser means such as a condenser lens in front of the photodetector or by using a photodetector having a larger light receiving face.

An experiment was carried out to investigate the relation between generation of unsatisfactory ink scraping and the resistance between the piston 13 and the inner surface of the cylinder 12 in the following manner. The result is reported in the following table 1. First to sixteenth ink containers 10, which were different in resistance generated by friction between the cylinder 12 and the piston 13 when the piston 13 was slid toward the ink discharge port 11 with the ink container 10 held empty, were prepared and were used in the printer shown in FIG. 3. Then the parts of the cylinder 12 onto which light was projected were visually checked on whether unsatisfactory ink scraping was generated. Further, the ink containers 10 were checked on whether the ink remainder was successfully detected. In the following table, the ink containers where unsatisfactory ink scraping was not generated and the ink remainder was successfully detected were marked with ○, those where though unsatisfactory ink scraping was partly generated, the ink remainder was successfully detected were marked with Δ and those where unsatisfactory ink scraping was generated and the ink remainder was not successfully detected were marked with X. The resistance generated by friction between the cylinder 12 and the piston 13 was taken as the value when the piston 13 was pushed toward the ink discharge port 11 at a speed of 100 mm/min by the use of Shimazu Autograph AGS-500D (SHIMAZU corporation).

TABLE 1

| No. | N | evaluation |
|---|---|---|
| #1 | 5.1 | □ |
| #2 | 5.7 | □ |
| #3 | 6.1 | □ |
| #4 | 5.4 | □ |
| #5 | 3.4 | □ |
| #6 | 3.1 | □ |
| #7 | 3.8 | ○ |
| #8 | 4.0 | ○ |
| #9 | 2.2 | Δ |
| #10 | 2.1 | □ |
| #11 | 2.5 | ○ |
| #12 | 2.0 | □ |
| #13 | 0.4 | X |
| #14 | 0.3 | X |
| #15 | 1.0 | □ |
| #16 | 0.8 | X |

As can be understood from table 1, when the resistance is not lower than 2.5N, unsatisfactory ink scraping was not generated, and when the resistance is not lower than 1.0N, though unsatisfactory ink scraping was partly generated, the ink remainder was successfully detected. The resistance in the empty container was equivalent to that after the inner surface of the cylinder 12 and the piston 13 wet with ink was lightly wiped with solvent.

In order to accurately detect the ink remainder even if unsatisfactory ink scraping is generated, the cylinder 12 is formed so that the gross transmittance y [% t] to light at 900 nm of the side wall of the cylinder 12 after ink 16 is scraped off the inner surface of the side wall of the cylinder 12 satisfies formula y=ax, wherein a is a coefficient not smaller than 21 and x represents a minimum output voltage of the photodetector 20.

For example, when the cylinder 12 is formed of polypropylene and the piston 13 is of high-density polyethylene, formula y=ax can be satisfied by setting the inner diameter of the cylinder 12 to 76.3±0.05 mm (76.3 mm in average) and setting the outer diameter of the piston 13 (including the ink scraper portion 14 and the piston support portion 15) as measured before the piston 13 is inserted into the cylinder 12 to at least 76.9 mm.

The coefficient a is empirically obtained on the basis of the relation between the output voltage of the photodetector 20 and the gross transmittance of the side wall of the cylinder 12. For example, light is received by the photodetector 20 through side walls of the cylinder having different degrees of stain and the output voltages of the photodetector 20 are detected and plotted against transmittances of the side wall of the cylinder 12. Then the inclination of a straight line representing the plot is taken as the coefficient a. This will be described in more detail later.

Though the minimum output voltage of the photodetector 20 varies by the performance of the photodetector, the term "minimum output voltage of the photodetector" should be interpreted to be the minimum voltage that a detecting means for detecting the output voltage of the photodetector 20, e.g., an ink remainder detecting circuit in the ink remainder detection control board 21 shown in FIG. 2, can detect. The detecting means can detect the ink remainder when the voltage output from the photodetector 20 reaches a predetermined value, which varies depending upon the performance of the detecting means 20.

An example of determining the coefficient a will be described, hereinbelow.

Figure 4:
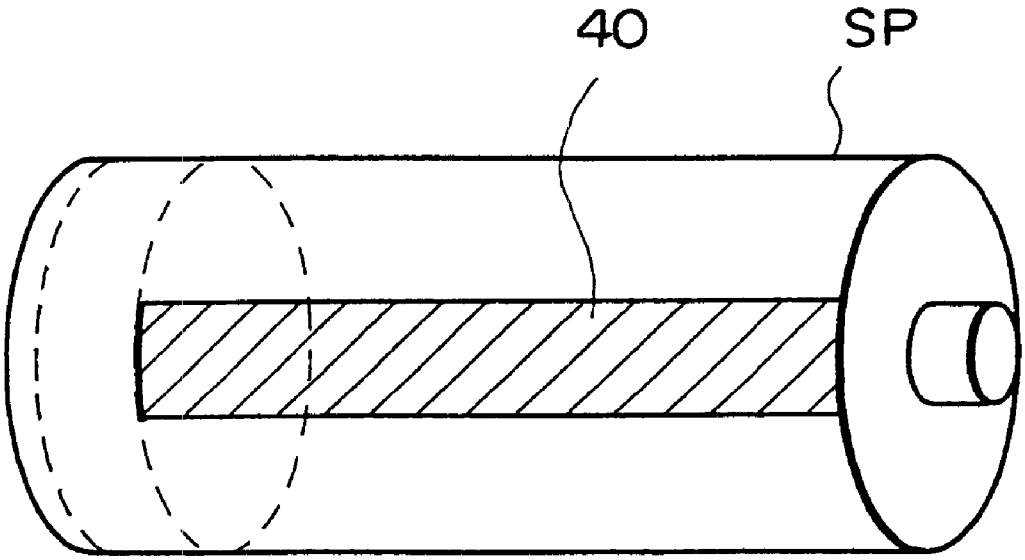
FIG. 4 is a view showing the cylinder samples for obtaining the value of the coefficient a, FIG. 5 is a view showing the relation between the output voltage (V) of the photodetector (x-axis) and the gross transmittance of the cylinder samples (y-axis) for 0% inner surface stain and 100% inner surface stain.

Cylinder samples SP of different transmittances were prepared. The cylinder samples SP were 0%, 4%, 6%, 12% and 21%, respectively, in net transmittance to light at 900 nm as measured by the use of Spectrophotometer V-570:Integrating Sphere Unit (manufactured by JASCO corporation). In order to reproduce various degrees of stain with ink of the inner surface of the side wall of the cylinder 12, black paper strips 40 (FIG. 4) which were 25%, 50%, 75% and 100% of the side surface of the cylinder 12 in area were prepared. All the paper strips 40 were of the same length as the cylinder 12 taking into account the fact that the ink can drag along the longitudinal axis of the cylinder to adhere to the inner surface of the side wall of the cylinder 12.

One of the cylinders of each transmittance was attached with no paper strip and the other cylinders of each transmittance was attached with the black paper strips 40 of 25%, 50%, 75% and 100% of the side surface of the cylinder 12 (corresponding to 25%, 50%, 75% and 100% inner surface stain degrees) with their longitudinal axes extending in parallel to the side rib of the cylinder sample SP, along which ink was apt to be left.

The cylinder samples SP in this state were set to the printer shown in FIG. 3, and the output voltage of the photodetector 20 was measured.

Figure 5:
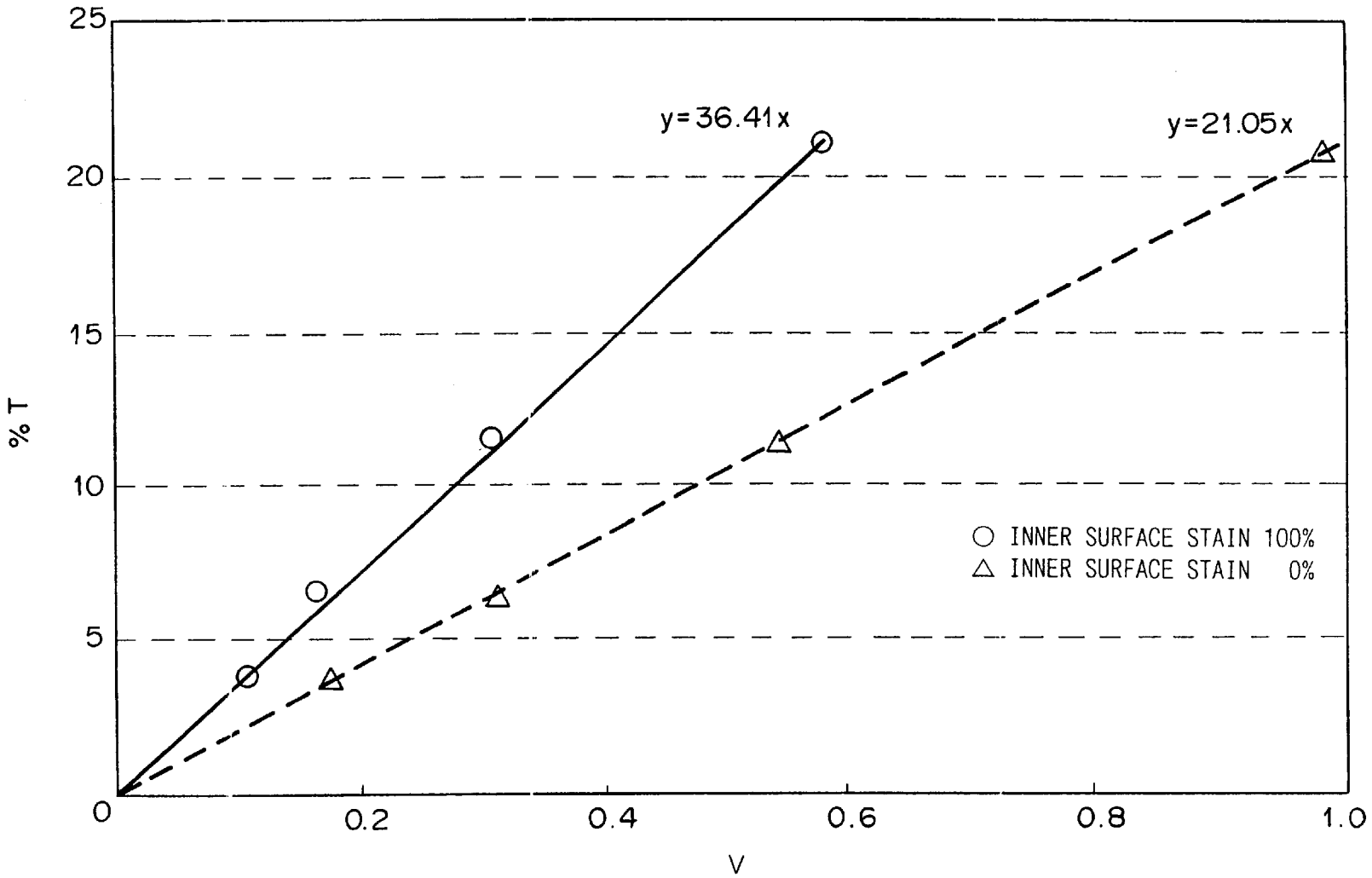

The measured output voltages were as shown in the following table 2. Further, FIG. 5 shows the relation between the output voltage (V) of the photodetector 20 (x-axis) and the gross transmittance of the cylinder samples SP (y-axis) for 0% inner surface stain and 100% inner surface stain. As can be seen from FIG. 5, the inclination of a straight line representing the plot for 0% inner surface stain (for the best condition) is about 21 and the inclination of a straight line representing the plot for 100% inner surface stain (for the worst condition) is about 36. Accordingly, the value of the coefficient a is generally set to 21 and preferably 36. For example, when the minimum output voltage of the photodetector 20 is 0.15V and the coefficient a is 36, the gross transmittance of the side wall of the cylinder is 5.4% T. This means that the ink remainder can be accurately detected even if the ink stain is 100% by forming the side wall of the cylinder so that the gross transmittance of the side wall is at least 5.4% T.

TABLE 2

| net transmit. | output voltage (V) | | | | |
|---|---|---|---|---|---|
| (% T) | stain 0% | stain 25% | stain 50% | stain 75% | stain 100% |
| 21 | 0.994 | 0.800 | 0.713 | 0.710 | 0.586 |
| 12 | 0.546 | 0.447 | 0.397 | 0.392 | 0.304 |
| 6 | 0.301 | 0.250 | 0.219 | 0.217 | 0.162 |
| 4 | 0.195 | 0.163 | 0.142 | 0.136 | 0.107 |
| 0 | 0 | 0 | 0 | 0 | 0 |

Also, in this embodiment, the color of ink, the wavelength of the emitted from the light projecting means, and the like need not be limited to a particular range. Further, it is possible to improve accuracy in detecting the ink remainder by increasing light collecting efficiency, for instance, by disposing a light condenser means such as a condenser lens in front of the photodetector or by using a photodetector having a larger light receiving face.

Figure 6:
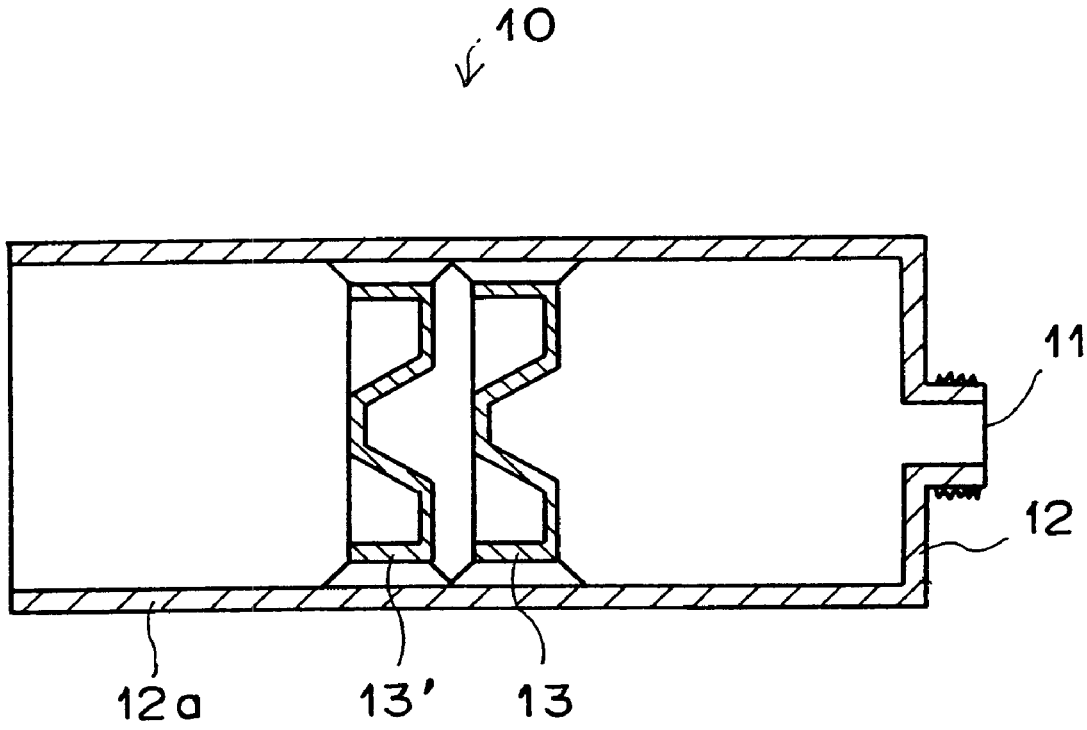
FIG. 6 is a cross-sectional view of an ink container in accordance with another embodiment of the present invention.

Further, though only one piston 13 is fitted in the cylinder 12 in the embodiments described above, a plurality of the pistons 13, 13' may be fitted in the cylinder 12 as shown in FIG. 6. With this arrangement, ink is further better scraped off the inner surface of the side wall of the cylinder 12, whereby generation of unsatisfactory ink scraping can be further more surely avoided and the gross transmittance of the side wall of the cylinder 12 can be further increased.

Though, in the embodiments described above, the piston support portion 15 is annular in shape. However, when the piston support portion 15 is annular, the ink accidentally entering the space between the ink scraper portion 14 and the piston support portion 15 can be dragged along the longitudinal axis of the cylinder by the piston support portion 15 to stain the inner surface of the side wall of the cylinder 12 in a strip-like or stripe pattern.

Figure 7A:
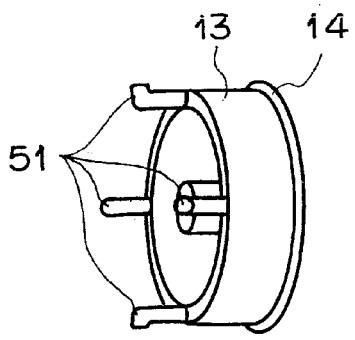
FIGS. 7A to 7D are views showing various modifications of the piston.
Figure 7B:
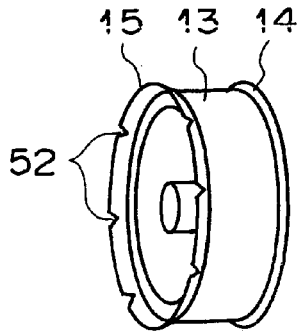
Figure 7C:
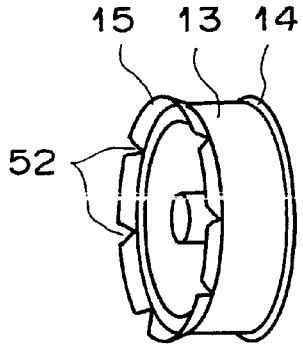
Figure 7D:
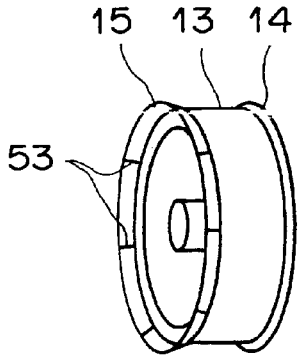

In order to avoid this problem it is preferred that the piston support portion 15 be discontinuous as shown in FIGS. 7A to 7D. For example, the piston support portion 15 may be in the form of a plurality of projections extending in a direction parallel to the longitudinal axis of the cylinder 12 as shown in FIG. 7A. A plurality of notches 52 may be formed on an annular piston support portion 15 as shown in FIGS. 7B and 7C. The notches 52 shown in FIG. 7B are shallow and partly cut the support portion 15, whereas the notches 52 shown in FIG. 7C are deep and cut the support portion 15 to the root thereof. Otherwise, the annular piston support portion 15 may be cut to form a plurality of slits 53 as shown in FIG. 7D.

Further, the ink container of the present invention may be incorporated in a printer where the ink remainder is detected by projecting light onto the cylinder from one side thereof and receiving light passing through the cylinder on the other side thereof.

What is claimed is:

1. An ink container comprising:

a cylinder provided with an ink discharge port at its leading end; and a plurality of pistons fitted in the cylinder to be slidable along the inner surface of a side wall of the cylinder so that ink is filled into the space defined by the cylinder and the pistons, wherein the resistance generated by friction between the cylinder and the pistons when the pistons are slid toward the ink discharge port with the ink container held empty is not lower than 1.0N.

2. An ink container as defined in claim 1 in which the resistance is not lower than 2.5N.

3. An ink container as defined in claim 1 in which at least one annular ink scraper portion is provided on the pistons to extend radially outward so that its surface facing toward the ink discharge port makes an angle not smaller than 90° to the inner surface of the sidewall of the cylinder as measured toward the ink discharge port from the surface facing toward the ink discharge port.

4. An ink container as defined in claim 1 incorporated in a printing device comprising a photodetector which outputs an electric signal according to the amount of light the photodetector receives, a light projecting means which projects detecting light toward the photodetector through the side wall of the cylinder, and an ink remainder detecting means which detects the remainder of ink in the ink container on the basis of the electric signal output from the photodetector.

5. An ink container as defined in claim 4 in which the photodetector is disposed near the trailing end of the cylinder, a plurality of the light projecting means are provided in a plurality of different positions in the longitudinal direction of the cylinder and are turned on in different manners by position, and the ink remainder detecting means detects the remainder of ink in the ink container on the basis of change in the electric signal output from the photodetector.

6. An ink container as defined in claim 4 in which the resistance generated by friction between the cylinder and the pistons when each piston slides towards the ink discharge port with the ink container held empty is at least 2.5N at the portion where the light projecting means projects the detecting light.

7. An ink container comprising:

a cylinder provided with an ink discharge port at its leading end; and a piston fitted in the cylinder to be slidable along the inner surface of a side wall of the cylinder so that ink is filled into the space defined by the cylinder and the piston, wherein the resistance generated by friction between the cylinder and the piston when the piston is slid toward the ink discharge port with the ink container held empty is not lower than 1.0N, and wherein the gross transmittance y [% t] to light at 900 nm of the side wall of the cylinder after ink is scraped off the inner surface of the side wall of the cylinder satisfies formula y=ax, wherein a is a coefficient not smaller than 21 and x represents a minimum output voltage of a photodetector.

8. An ink container as defined in claim 7 in which the coefficient a is not smaller than 36.

9. An ink container as defined in claim 7 in which a plurality of the pistons are fitted in the cylinder.

10. An ink container as defined by claim 7 in which the piston is provided with at least one annular ink scraper portion which extends radially outward from the piston and a piston support portion which extends radially outward from the piston to contact with the cylinder and support the piston in the cylinder.

11. An ink container as defined in claim 10 in which the piston support portion is in the form of at least one projection.

12. An ink container as defined in claim 10 in which the piston support portion is in the form of an annular member provided with a plurality of cutaway portions.

13. An ink container as defined in claim 7 incorporated in a printing device comprising:

a photodetector which outputs an electric signal according to the amount of light the photodetector receives;

a light projecting means which projects detecting light toward the photodetector through the side wall of the cylinder; and an ink remainder detecting means which detects the remainder of ink in the ink container on the basis of the electric signal output from the photodetector.

14. An ink container as defined in claim 13 in which the photodetector is disposed near the trailing end of the cylinder, a plurality of the light projecting means are provided in a plurality of different positions in the longitudinal direction of the cylinder and are turned on in different manners by position, and the ink remainder detecting means detects the remainder of ink in the ink container on the basis of change in the electric signal output from the photodetector.

15. An ink container as defined in claim 13 in which the resistance generated by friction between the cylinder and the pistons when each piston slides towards the ink discharge port with the ink container held empty is at least 2.5N at the portion where the light projecting means projects the detecting light.

16. An ink container as defined in claim 7 in which the resistance is not lower than 2.5N.

17. An ink container as defined in claim 7, in which at least one annular ink scraper portion is provided on the piston to extend radially outward so that its surface facing toward the ink discharge port makes an angle not smaller than 90° to the inner surface of the sidewall of the cylinder as measured toward the ink discharge port from the surface facing toward the ink discharge port.

18. An ink container as defined in claim 7 in which a plurality of pistons are fitted in the cylinder.

* * * * *